US009477244B2

(12) United States Patent
Luo et al.

(10) Patent No.: US 9,477,244 B2
(45) Date of Patent: Oct. 25, 2016

(54) LINEAR REGULATOR WITH IMPROVED POWER SUPPLY RIPPLE REJECTION

(71) Applicant: Lattice Semiconductor Corporation, Portland, OR (US)

(72) Inventors: Kexin Luo, Shanghai (CN); Fangqing Chu, Shanghai (CN); Yu Shen, Beijing (CN); Zhi Wu, Shanghai (CN); Inyeol Lee, Saratoga, CA (US)

(73) Assignee: Lattice Semiconductor Corporation, Portland, OR (US)

( * ) Notice: Subject to any disclaimer, the term of this patent is extended or adjusted under 35 U.S.C. 154(b) by 8 days.

(21) Appl. No.: 14/381,186

(22) PCT Filed: Jan. 10, 2014

(86) PCT No.: PCT/CN2014/070450

§ 371 (c)(1),
(2) Date: Aug. 26, 2014

(87) PCT Pub. No.: WO2015/103768

PCT Pub. Date: Jul. 16, 2015

(65) Prior Publication Data

US 2016/0085250 A1 Mar. 24, 2016

(51) Int. Cl.
*G05F 1/46* (2006.01)
*G05F 1/56* (2006.01)

(52) U.S. Cl.
CPC ..... *G05F 1/468* (2013.01); *G05F 1/56* (2013.01)

(58) Field of Classification Search
CPC ..... G05F 1/465; G05F 1/56
See application file for complete search history.

(56) References Cited

U.S. PATENT DOCUMENTS

| | | | | |
|---|---|---|---|---|
| 8,552,794 | B2 * | 10/2013 | Hirobe | G05F 3/242 327/539 |
| 2005/0007167 | A1 * | 1/2005 | Tange | H02H 9/001 327/172 |
| 2005/0099224 | A1 * | 5/2005 | Itoh | G05F 1/565 327/541 |
| 2006/0061346 | A1 * | 3/2006 | Lee | G05F 1/465 323/313 |
| 2013/0162227 | A1 * | 6/2013 | Kodama | G05F 1/575 323/234 |

FOREIGN PATENT DOCUMENTS

| | | |
|---|---|---|
| CN | 101075143 A | 11/2007 |
| CN | 202374178 U | 8/2012 |
| CN | 103163929 A | 6/2013 |

OTHER PUBLICATIONS

PCT International Search Report and Written Opinion, PCT Application No. PCT/CN2014/070450, Oct. 15, 2014. 12 pages.

* cited by examiner

*Primary Examiner* — Jue Zhang
(74) *Attorney, Agent, or Firm* — Fenwick & West LLP

(57) ABSTRACT

Embodiments of the invention are generally directed to a linear regulator with improved power supply ripple rejection. An embodiment of an apparatus includes an linear regulator to receive a system power supply and to generate a regulated power supply; a first voltage reference generator to generate a first voltage reference for the linear regulator; a second voltage reference generator to generate a second voltage reference for the linear regulator; and a voltage reference and power switcher. In some embodiments, the voltage reference and power switcher is to switch a voltage reference for the linear regulator from the first voltage reference to the second voltage reference and is to switch a part of a power supply for the linear regulator from the system power supply to the regulated power supply.

22 Claims, 7 Drawing Sheets

LINEAR REGULATOR WITH IMPROVED POWER SUPPLY RIPPLE REJECTION

TECHNICAL FIELD

Embodiments of the invention generally relate to the field of electronic circuits, and, more particularly, to a linear regulator, further with improved power supply ripple rejection ratio (PSRR).

BACKGROUND

In operation of electronic circuits, power supply ripple rejection ratio (PSRR) is a measure of the capability of a circuit to reject ripple (also known as ripple voltage) that is coming from an input power supply. Ripple is a small periodic variation of the direct current (DC) output of the power supply, where ripple is generally due to incomplete rectification or suppression of an alternating current (AC) source that is rectified to generated the DC output. Ripple thus is an alternating component of a voltage from a rectifier or generator. PSRR may measure such capability at various frequencies.

An example of a linear regulator is an LDO (low dropout) regulator, which is a direct current (DC) linear voltage regulator producing a regulated power supply output. A LDO regulator is intended to maintain a specified output voltage over a wide range of load current and input voltage, where the difference between the input and output voltages is referred to as the dropout voltage. A linear regulator generally includes a power transistor and an error amplifier, which may also be referred to as a differential amplifier. For a linear regulator such as an LDO regulator, PSRR is a measure of the output ripple compared to the input ripple over a frequency range, which is generally a wide frequency range, such as, for example, 10 Hz (hertz) to 10 MHz (megahertz) expressed in decibels (dB).

However, linear regulators often do not provide sufficient rejection of ripple voltage. The remaining ripple voltage can affect circuit operation, or require additional efforts to control the remaining ripple in the power supply output from the linear regulator.

BRIEF DESCRIPTION OF THE DRAWINGS

Embodiments of the invention are illustrated by way of example, and not by way of limitation, in the figures of the accompanying drawings in which like reference numerals refer to similar elements.

SUMMARY

Figure 1:
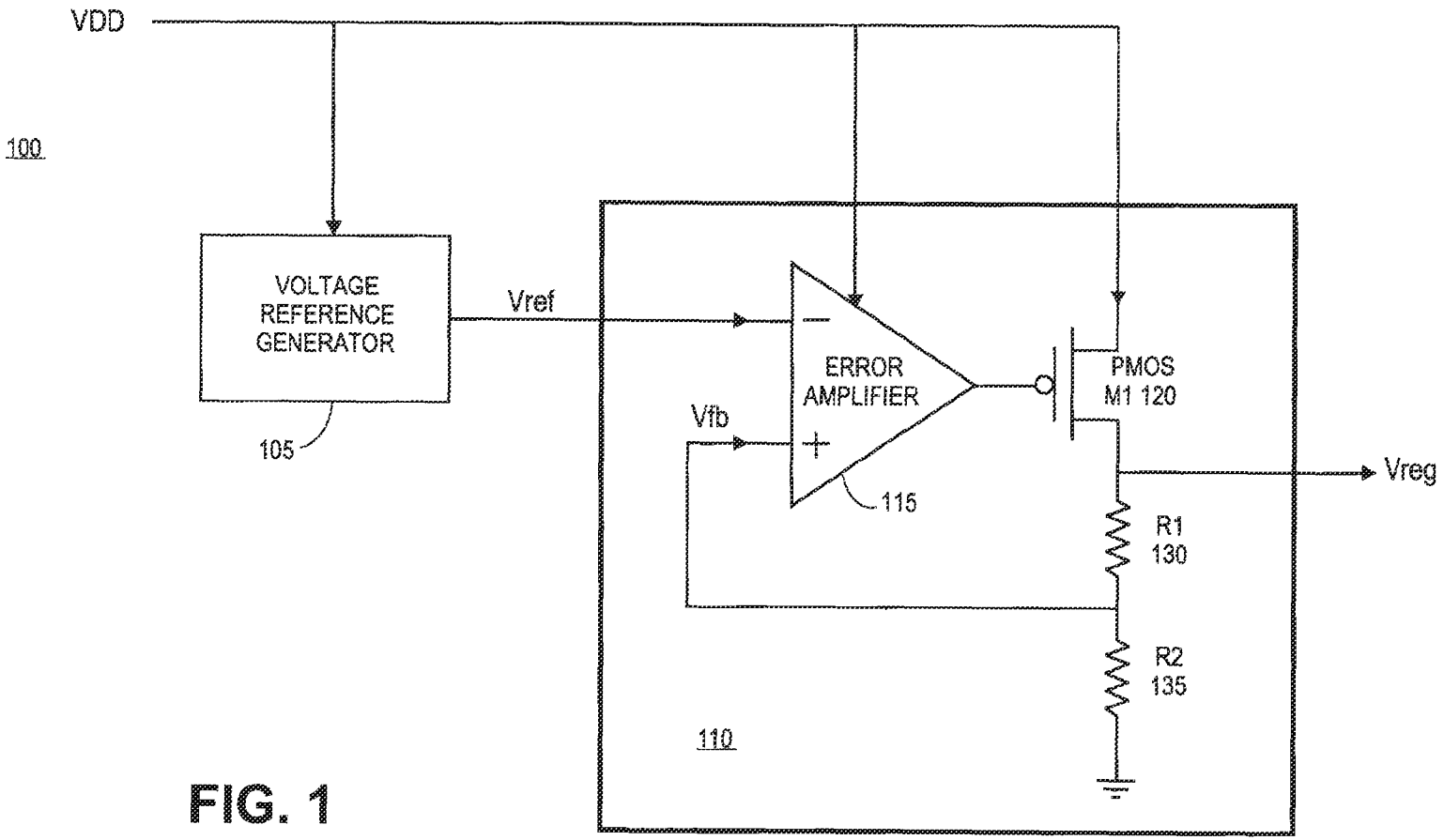
FIG. 1 (PRIOR ART)
FIG. 1 illustrates a circuit including a conventional linear regulator.

Embodiments of the invention are generally directed to a linear regulator with improved power supply ripple rejection.

In a first aspect of the invention, an embodiment of an apparatus includes an linear regulator to receive a system power supply and to generate a regulated power supply; a first voltage reference generator to generate a first voltage reference for the linear regulator; a second voltage reference generator to generate a second voltage reference for the linear regulator; and a voltage reference and power switcher. In some embodiments, the voltage reference and power switcher is to switch a voltage reference for the linear regulator from the first voltage reference to the second voltage reference and is to switch a part of a power supply for the linear regulator from the system power supply to the regulated power supply.

In a second aspect of the invention, an embodiment of a method includes initializing a voltage regulator circuit; generating a first voltage reference by a first voltage reference generator; providing the first voltage reference to a linear regulator, the linear regulator receiving a system power supply voltage; generating a regulated power supply voltage by the linear regulator; providing the regulated power supply voltage to the second voltage reference generator; generating a second voltage reference by the second voltage reference generator; and switching a voltage reference for the linear regulator from the first voltage reference to the second voltage reference and switching a part of a power supply for the linear regulator from the system power supply to the regulated power supply.

In a third aspect of the invention, an embodiment of a circuit to provide a voltage reference includes a first circuit portion to provide a first reference for a linear generator, the linear generator to receive a system power supply voltage and to generate a regulated power supply voltage, the first circuit including a connection to the system power supply voltage; a second circuit portion to provide a second reference for the linear generator, the second circuit portion including a connection to the regulated power supply voltage; and a third circuit portion to provide switching between the first reference produced by the first circuit portion and the second reference produced by the second circuit portion.

DETAILED DESCRIPTION

Embodiments of the invention are generally directed to a low dropout regulator with improved power supply ripple rejection.

In some embodiments, a method, apparatus, or system provides for a linear voltage regulator circuit, the circuit providing that after the regulator starts up with an initial voltage reference such reference is switched to a new voltage reference that is powered by the regulator output. As used herein, a linear voltage regulator is generally referred to as a linear regulator. In some embodiments, the switching of voltage reference results in operation in which the PSRR of the circuit is improved. An embodiment of a linear regulator may include, but is not limited to, an LDO (low dropout) regulator.

The basic equation for determination of PSRR is:

$$PSSR = 20\log\frac{\text{Ripple}_{Input}}{\text{Ripple}_{Output}} \quad [1]$$

For a linear regulator PSRR may be expressed as $$PSSR = 20\log\frac{A_V}{A_{VO}}$$

Where: $A_{VO}$=Open loop gain of the regulator feedback loop $A_V$=Gain from VIN to VOUT with regulator feedback loop open In a conventional regulator, noise or ripple in the power supply can affect the regulator output voltage through the voltage reference generator, the error amplifier, and the PMOS transistor of the regulator. In some embodiments, if the power supply of the bias generator is switched to the regulator output after the regulator is powered up, then the PSRR will be improved because of the use of the generated output, which has reduced ripple voltage. However, such a switching process includes a potential problem because in operation a regulator may fail to operate if bias and power switching are not handled properly. The regulator requires the voltage reference in order to generate an output, while the voltage reference generator requires the regulator to provide the regulated power supply output for the voltage reference generator to generate the voltage reference.

In some embodiments, a circuit provides for switching part of an error amplifier power supply from the initial power supply to the regulator output voltage. In some embodiments, the switching is performed by a reference and power switcher, where the reference and power switcher operates to switch the voltage reference and power supply at the same time, thus the switching process allows the error amplifier to continue working at all times.

FIG. 1 illustrates a circuit including a conventional linear regulator. In this illustration, a circuit 100 includes an linear regulator 110 receiving a voltage reference Vref from a voltage reference generator 105, the voltage reference generator 105 and linear regulator being coupled to system power supply VDD. The linear regulator 110 includes an error amplifier 115 receiving voltage reference Vref and feedback voltage Vfb. The output of the error amplifier 115 is received at a gate of a PMOS transistor, M1 120, where a first terminal of M1 120 is coupled with VDD and a second terminal is coupled with output voltage Vreg and a first terminal of resistor R1 130. A second terminal of R1 is coupled with the line for feedback voltage Vfb and a first terminal of resistor R2, a second terminal of R2 being coupled with ground.

As shown in FIG. 1, noise in the system power supply VDD can affect the regulator output voltage Vreg through voltage reference generator 105, the error amplifier 115, and the PMOS transistor, M1 120.

Figure 2:
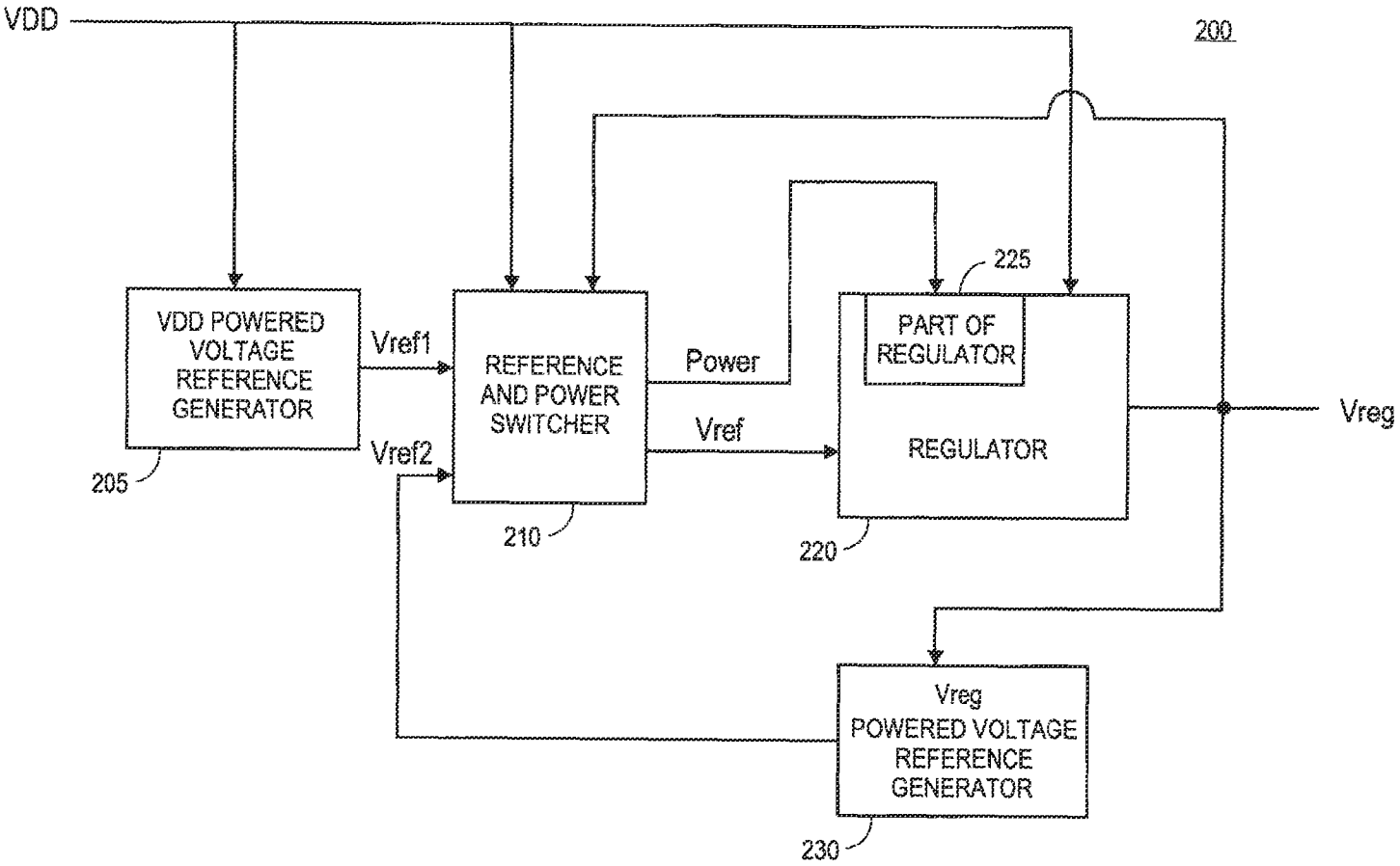
FIG. 2 illustrates an embodiment of a modified linear regulator.

FIG. 2 illustrates an embodiment of a modified linear regulator. In some embodiments, a circuit 200 includes a VDD powered voltage reference generator 205 coupled with source voltage VDD to produce a first voltage reference Vref1 and provides Vref1 as a first input to reference and power switcher 210, which receives a second input Vref2 produced by Vreg powered voltage reference generator 230. The reference and power switcher 210 further receives VDD and outputs a power output and voltage reference Vref. The voltage reference Vref is provided to an linear regulator 220 and the power output is provided to a part of the linear regulator 225. The linear regulator may be an LDO or other type of linear regulator. The linear regulator 220 produces the regulated power output Vreg, which is fed back to the reference and power switcher 210 and the Vreg powered voltage reference generator 230.

In some embodiments, as shown in the circuit provided in FIG. 2, the voltage reference is switched from the VDD powered voltage reference generator 205 to the Vreg powered voltage reference generator 230 and simultaneously part of the regulator power supply is switched from VDD to the linear regulator power output, where the switching is performed by means of the reference and power switcher 210. In some embodiments, the part of the regulator power supply is a portion of the power supply for an error amplifier of the regulator. In operation, the PSRR can be significantly improved by the switching to the Vreg powered voltage reference generator 230 and the regulator power output.

Figure 3:
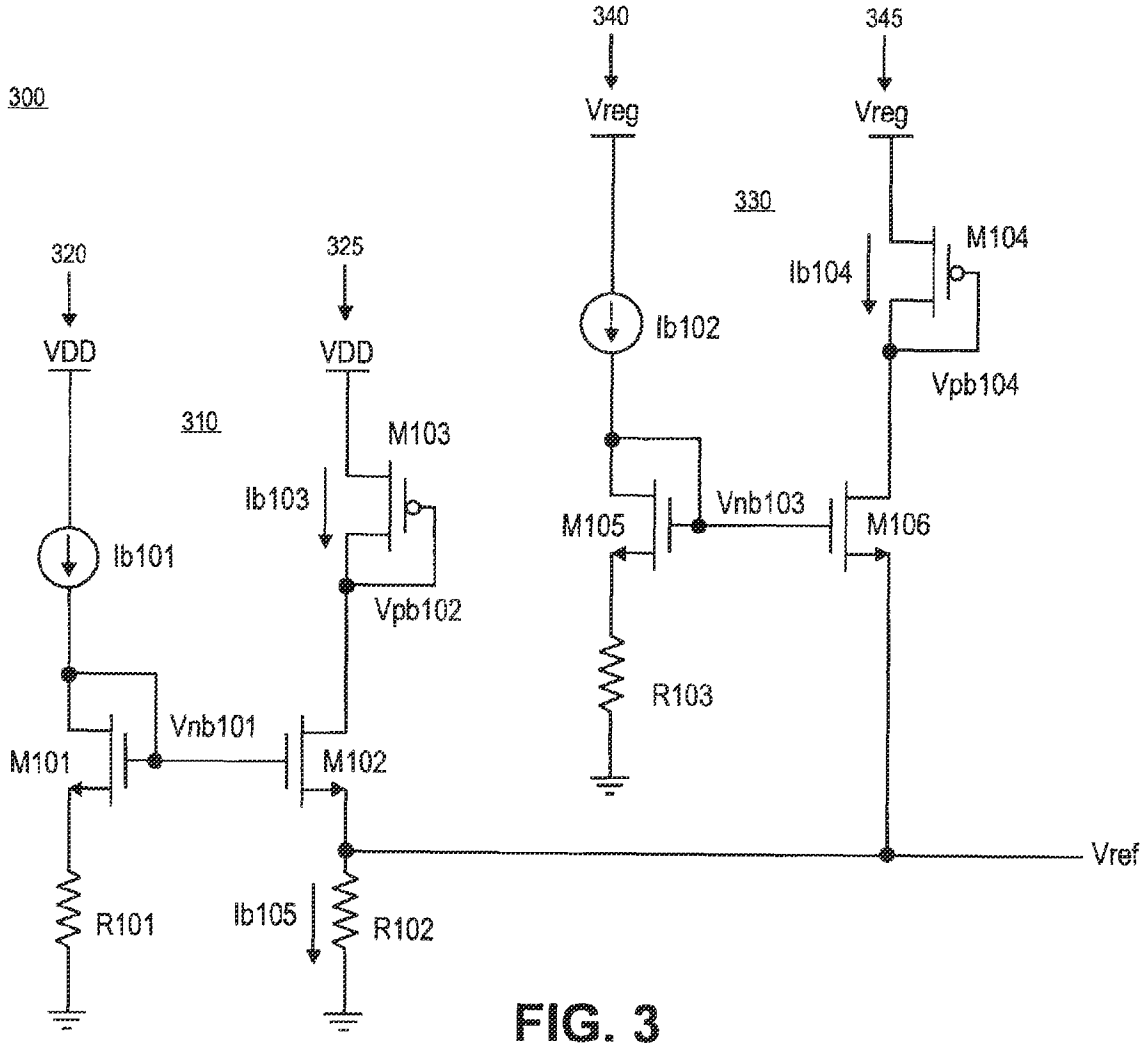
FIG. 3 illustrates an embodiment of voltage reference generators and switching elements according to an embodiment.

FIG. 3 illustrates an embodiment of voltage reference generators and switching elements for a linear regulator according to an embodiment. In some embodiments, a first circuit portion 310 includes a VDD powered voltage reference generator (such as, for example, VDD powered voltage reference generator 205 illustrated in FIG. 2) receiving VDD as a voltage source, the first circuit portion 310 including a first branch 320 and a second branch 325, and a second circuit portion 330 includes a Vreg powered voltage reference generator (such as, for example, Vreg powered voltage reference generator 230 illustrated in FIG. 2) receiving Vreg as a voltage source, the second circuit portion 330 including a third branch 340 and a fourth branch 345. In some embodiments, a third circuit portion 350 includes a differential pair of transistors, including NMOS transistor M102, which may be referred to a first differential transistor, and NMOS transistor M106, which may be referred to as a second differential transistor, and a resistor R102, which may be referred to as a tail resistor.

In some embodiments, the first branch 320 includes a current source Ib101 providing a current Ib101 to diode-connected NMOS transistor M101 (connecting gate to drain of M101), where the source of M101 is connected to a first terminal of resistor R101, a second terminal of R101 connected to ground, M101 producing bias voltage Vnb101.

In some embodiments, the second branch 325 includes diode connected PMOS transistor M103, providing bias current Ib103, the source of M103 being connected to VDD and connected drain and gate providing voltage Vpb102. The second branch 325 connects with NMOS transistor M102, where the gate of M102 receives bias voltage Vnb101 from M101, the drain of M102 receives voltage Vpb102 from M103, and the source of M102 provides output voltage reference Vref (which may be referred to as Vref1), the source of M102 being connected to a first terminal of resistor R102, a second terminal of R102 being connected to ground, current Ib105 flowing through R102.

In some embodiments, the third branch 340 includes a current source Ib102 providing current Ib102 to diode-connected NMOS transistor M105 (connecting gate to drain of M105), where the source of M105 is connected to a first terminal of resistor R103, a second terminal of R103 connected to ground, M105 producing bias voltage Vnb103.

In some embodiments, the fourth branch 345 includes diode connected PMOS transistor M104 providing bias current Ib104, the source of PMOS M104 being connected to Vreg and connected drain and gate producing voltage Vpb104. The fourth branch 345 connects with NMOS transistor M106, where the gate of NMOS M106 receives bias voltage Vnb103 from NMOS M105, the drain of NMOS M106 receiving Vpb104 from PMOS M104, and the source of NMOS M106 providing output Vref (which may be referred to as Vref2).

In FIG. 3, the transistors M102 (first differential transistor) and M106 (second differential transistor) represent a differential-pair structure, with the tail current source being tail resistor, R102. The two inputs of the differential-pair M102 and M106 are controlled by bias voltages Vnb101 and Vnb103 respectively. In some embodiments, this M102/M106 differential-pair provides the reference and power switcher for the regulator, such as, for example, reference and power switcher 210 illustrated in FIG. 2.

In some embodiments, the power supply switching process for the voltage regulator may be described as follows:

Before the linear regulator is powered up, bias voltage Vnb103 will be zero, and the current Ib105 will flow into M103, and it generates the bias voltage Vpb102. At this time, no current flows into M104, and Vpb104 is close to Vreg. After the linear regulator is powered up, Vnb103 is higher than Vnb101, and this causes the current Ib105 to switch to flowing into M104, with Vpb102 then being close to VDD. As a result, part of error amplifier power supply is switched from VDD to Vreg in FIG. 4.

In some embodiments, the reference switching process for the voltage regulator may be described as follows:

Before the linear regulator is powered up, the Vref equals to Ib101*R101+Vgs,M101−Vgs,M102, and after the linear regulator is powered up, the Vref will switch to Ib102*R103+Vgs, M105−Vgs, M106. To ensure that this happens. Vnb103 should higher than Vnb101.

Vref may also be expressed as follows:

$$Vref=(a\times Ib103+b\times Ib104)\times R102$$

Where:

(1) In an initial state before the regulator is powered up, a=1 while b=0.

(2) In a final state, a=0 while b=1.

(3) During the switching process for voltage reference and power, the Vref changes from Vref1=Ib101*R101+Vgs, M101−Vgs,M102 to Vref2=Ib102*R103+Vgs, M105−Vgs, M106. In some embodiments, a circuit is designed such that the difference between Vref1 and Vref2 is not very large, but is sufficiently large to ensure that the Ib105 in FIG. 3 is totally switched into M104 in the final state.

In some embodiments, M102 and M106 are essentially a differential-pair, and the differential pair requires a voltage difference to totally switch-off or switch-on. The gate voltage is Vref+Vgs. Referring to FIG. 2, there are two voltage references shown, Vref1 and Vref2. In FIG. 3, Vref 1 will be Ib101*R101+Vgs,M101−Vgs,M102, with Vnb101 being Vref1+Vgs,M102, while Vref2 will be Ib102*R103+Vgs, M105−Vgs,M106, with Vnb103 being Vref2+Vgs,M106. In order to totally switch the current Ib105 from Ib103 to Ib104, the voltage difference between Vref1 and Vref2 is established to be sufficiently large to provide the switching. However, this reference difference will affect the regulator output variation, and thus the voltage difference should not be excessively large.

In some embodiments, a mechanism may be added to the reference and power switcher 210 shown in FIG. 2. In some embodiments, the added mechanism operates to assist in pulling voltage Vnb101 to ground when voltage Vnb103 is high enough, the added mechanism serving to disable the first voltage reference Vref1.

In some embodiments, voltage Vref, as illustrated in FIG. 3, is not a constant value. Before the linear regulator is powered up, Vref equals Vref1=Ib101*R101+Vgs,M101−Vgs,M102. After the linear regulator is powered up, Vref equals Vref2=Ib102*R103+Vgs, M105−Vgs,M106. During the switching process, Vref changes from Vref1 to Vref2. Thus, Vref is not constant, but it is desirable that the variation be relatively small. Further, the Ib105 current also varies because Vref varies, with Ib105 equal to Vref/R102. It is also desirable that the Ib105 variation is relatively small.

Ib101 and Ib102 are not limited to a particular type of current generator, and may be, for example, bandgap, IPTAT (Inversely Proportional to Absolute Temperature). Vt/R, or constant-$g_m$ (transconductance) current generators. In some embodiments, Ib101 may also be independent of the VDD power supply. In some embodiments, Ib102 is not dependent on Vreg, and has stable operation such that Ib102 does not change with Vreg, where Vreg is controlled by Ib102*R103+Vgs, M105-Vgs,M106.

In an example, currents Ib101 and Ib102 may be generated by two separate bandgap generators, which may be referred to as bandgap1 and bandgap2 respectively. In this example, it may be ensured that VDD is 3.3V and Vreg is 1.2V, where Vreg should be high enough to make certain that bandgap2 operates properly. Further in this example, there is no resistor divider in the regulator feedback path, and thus Vfb equals Vreg. The switching process can be described as follows:

(1) Initially bandgap1 operates and generates Ib101, where, in this example, Vref=Vref1=1 V.

(2) Linear regulator output will be 1 V.

(3) Bandgap2 begins to operate, and it generates Ib102. As Ib102 increases, Vnb103 also increases. If the Vnb103 is higher than Vnb101 by about 200 mV, then Ib105 will totally flow into Ib104, and Ib103=0. At this point, Vref is equal to Vref2, 1.2 V.

(4) As the Vref increases from 1.0 v to 1.2 v, linear regulator output also increases from 1.0 V to 1.2 V. During this switching process, the current in M103 decreases from a certain current value to zero, and the current in M104 increases from 0 to a certain value. However, the variation of the sum of these two currents is small, such the error amplifier always operates.

Figure 4:
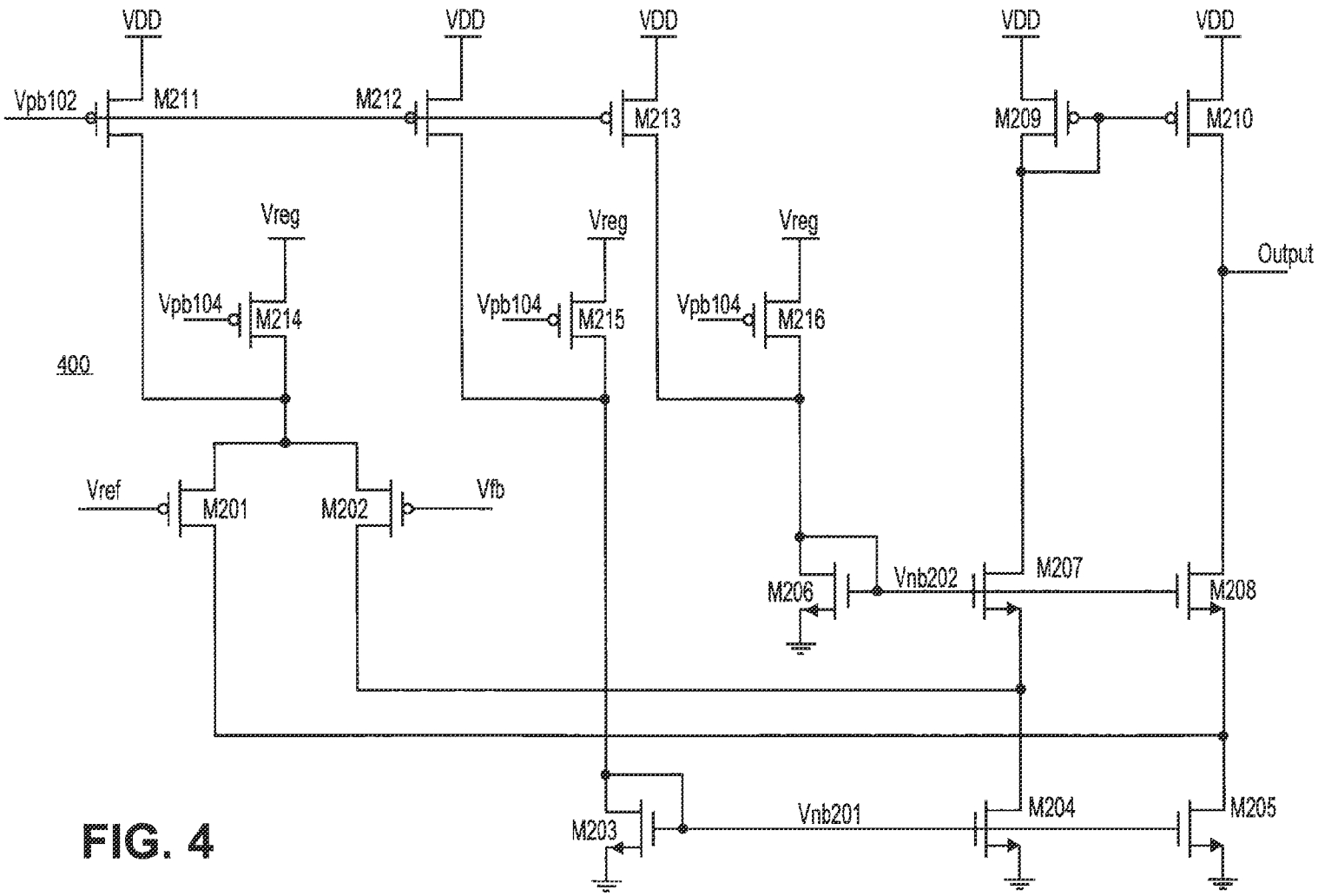
FIG. 4 illustrates an error amplifier with power switcher according to an embodiment.

FIG. 4 illustrates an error amplifier with power switcher 400 according to an embodiment. In some embodiments, the voltage reference Vref is used as the linear regulator input reference, and the bias voltage Vpb102 is used to operate the error amplifier. In an example, bias voltage Vpb102 is used to bias PMOS transistors M211, M212, M213, which provide tail current or bias current for a differential pair (M201 receiving Vreg and M202 receiving feedback voltage Vfb) or NMOS gate bias and cascode NMOS gate bias respectively. Thus, stated in other words, the output allows operation of the linear regulator, and the linear regulator provides Vreg output. In some embodiments, Vpb102 is generated by a first voltage reference generator, such as VDD powered voltage reference illustrated in FIG. 3. The output of the error amplifier is connected to a PMOS gate.

In some embodiments, the Vreg output of a linear regulator, such as linear regulator 220 illustrated in FIG. 2, will provide a power supply for a second voltage reference generator referred to herein as the Vreg powered voltage reference generator, the Vreg powered voltage reference generator providing bias current Ib102 in FIG. 3, this bias current generating the bias voltage Vnb103 (which is equal to Ib102*R103+Vgsm105, Vgsm105 being the voltage from gate to source of M105). In some embodiments, the bias voltage Vnb103 is established to be a value that is sufficiently higher than Vnb101 in order to ensure that the current Ib105 be totally switched from M102 to M106 in FIG. 3, and this current will generate another bias voltage Vpb104, which will be utilized in the error amplifier switching to regulator power domain.

In some embodiments, at the same time, Ib102 will also generate the Vref, which equals Ib102*R103+Vgsm105−Vgsm106. In an example, if R102 equals R103, and M105 and M106 are the same, then Vref will equal Ib102*R103. If the bias current Ib102 is a bandgap current, then the Vref will be a bandgap voltage (where bandgap currents and voltages refer to temperature independent reference values).

In some embodiments, a linear regulator circuit ensures that the linear regulator itself and its voltage reference continue operating when switching the reference and the power. For example, the power switching process in FIG. 4 can be seen in relation to FIG. 3 as when the current Ib105 is switching from Ib103 to Ib104, the sum of Ib103 and Ib104 will always equal to Ib105, the tail current, and the bias current of the error amplifier always be present. Further, the Vref voltage will vary from Ib101*R101+Vgsm101−Vgsm102 to Ib102*R103+Vgsm105−Vgsm106, but in operation the voltage will not fall too low or rise too high.

In some embodiments, transistors M214 and M211 in FIG. 4 provide a tail current source for the input differential-pair M201 and M202. As shown in FIG. 4, the gate voltage is Vpb102 and Vpb104, which both originate from the elements illustrated in FIG. 3. Before the linear regulator is powered up, M211 provides the tail current, while no current flows in the M214. After the linear regulator is powered up, no current flows in M211, while M214 provides the tail current. In this manner, the power supply for the differential-pair is switched from VDD to Vreg.

In some embodiments, the sum of the currents in M211 and M214 remain stable during the switching process. Referring to FIG. 3, the sum of Ib103 and Ib104 will equal Ib105 during the switching process, and with Ib105 having only small variation. In some embodiments, the current in M211 in FIG. 4 is proportional to Ib103 in FIG. 3, and the current in M214 is proportional to Ib104 in FIG. 4, which thus makes the sum of current in M211 and M214 proportional to Ib105 in FIG. 3. In this matter, this ensures that the error amplifier works well during the switching process, where the tail current source and the bias current do not change greatly or change abruptly.

In some embodiments, the M212 and M215 transistors operate in a similar fashion, the two transistors providing bias current to generate Vnb201 in FIG. 4, as do M213 and M216, which provides bias current to generate Vnb202 in FIG. 4.

Figure 5:
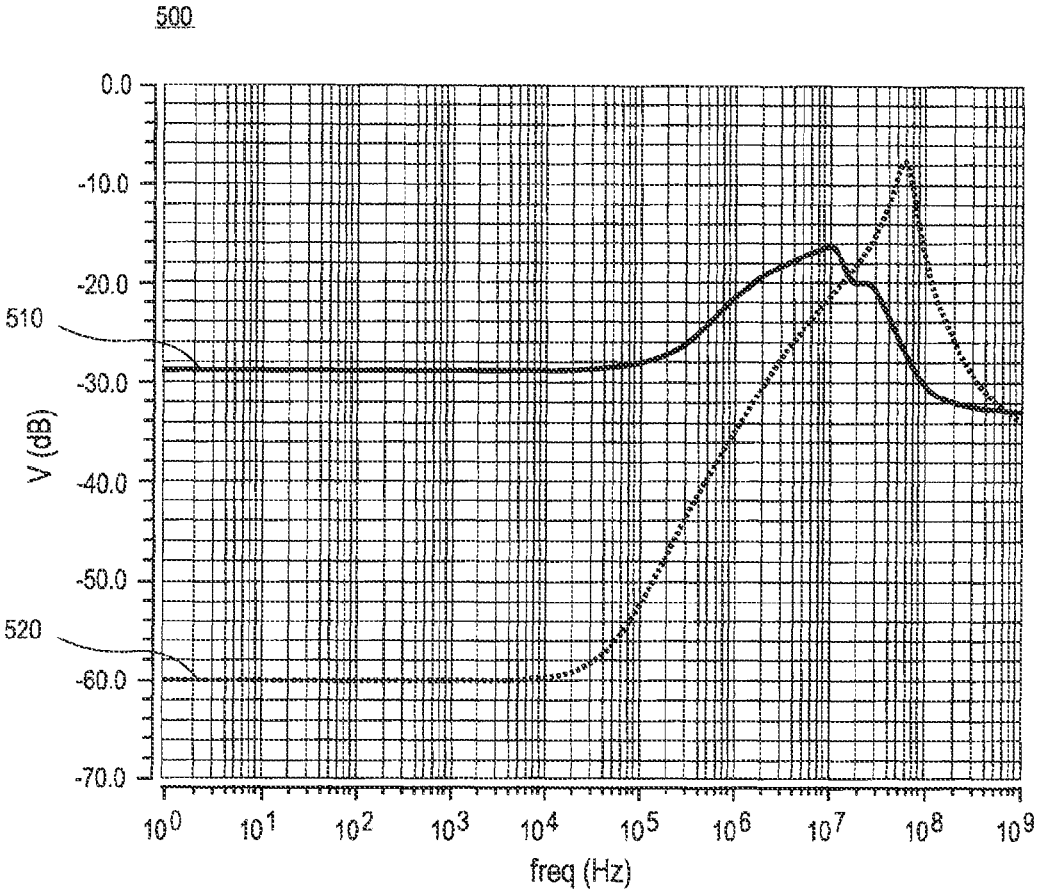
FIG. 5 illustrates response for the PSRR of a regulator according to an embodiment.

FIG. 5 illustrates response for the PSRR of a linear regulator according to an embodiment. As illustrated in FIG. 5, a simulation 500 is provided for linear regulator response, such as an LDO regulator. A first curve 510 illustrates a simulation result for a conventional linear regulator, and a second curve 520 illustrates a simulation result for a linear regulator according to an embodiment.

For the AC response of the PSRR of a linear regulator, the curves may be divided into 3 segments, which may be referred to as low-band, mid-band, and the high-band.

At low-band, the PSRR is mostly determined by the PSRR of the voltage reference generator because Vreg is proportional to Vref, if the gain of the error amplifier is high enough. Thus, the regulator output will track the voltage reference.

At mid-band, the gain of the error amplifier begins to decrease, and in this region the PSRR is determined by the bandwidth of the error amplifier itself. As the frequency becomes higher, the regulation ability of the error amplifier becomes weaker, the noise in the power supply will begin to affect the regulator output by other ways, such as by error amplifier or PMOS transistor.

At high-band, the PSRR will be determined by the parasitic capacitance and decoupling capacitance ratio. Essentially the noise in the power supply is transferred to the regulator output by means of a capacitor divider. In some embodiments, if high-frequency PSRR is an issue, additional decoupling capacitance may be added to the regulator output. The simulation provided in FIG. 5 utilizes capacitance of 2 pF (pico-farads) added to the regulator output.

Figure 6:
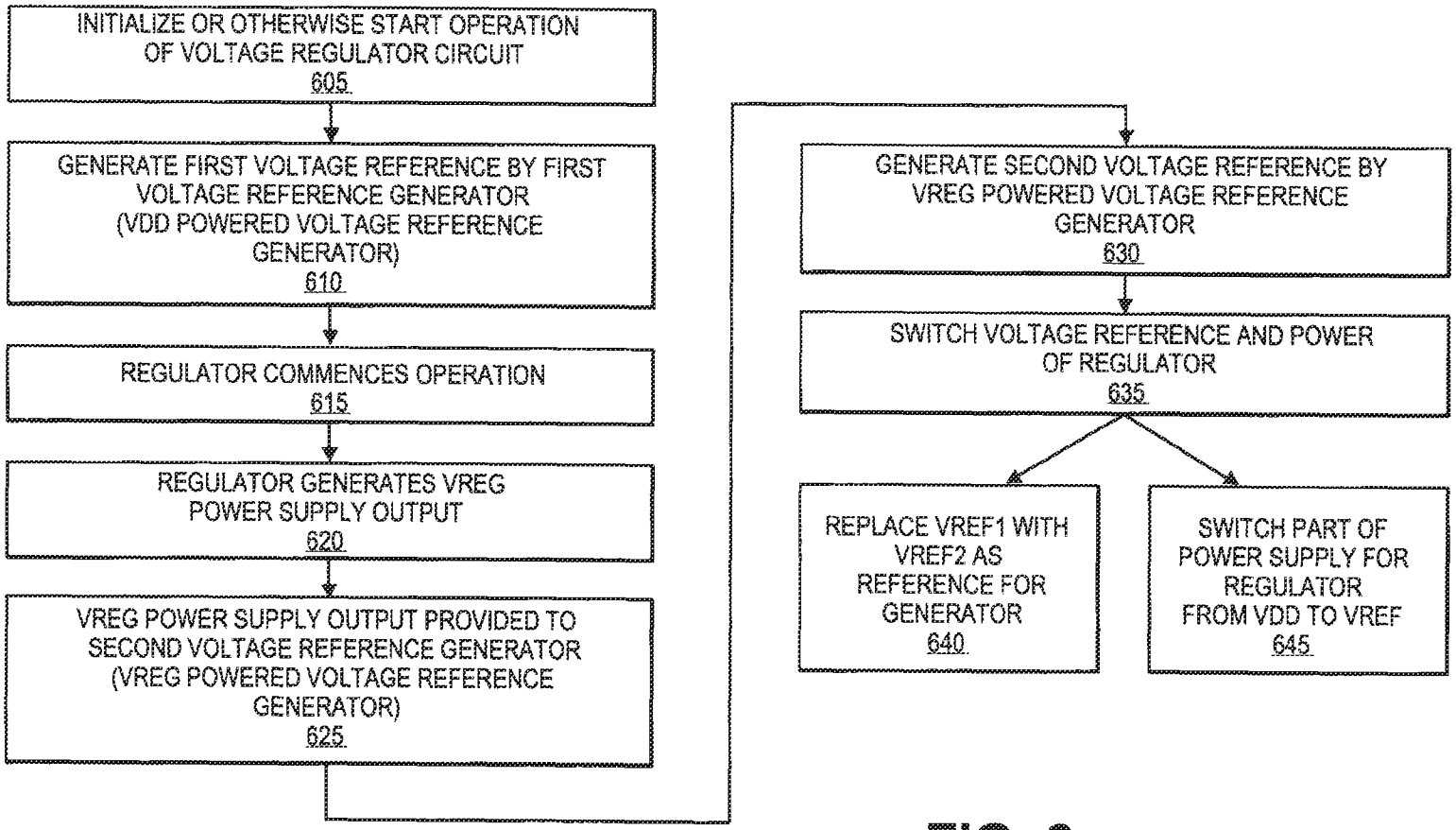
FIG. 6 is a flow chart to illustrate a process for generation of an output by linear regulation according to an embodiment.

FIG. 6 is a flow chart to illustrate a process for generation of an output by linear regulation according to an embodiment. In some embodiments, a linear regulator circuit is powered on or otherwise initialized 605.

In some embodiments, a first voltage reference generator generates a first voltage reference Vref1 and provides such voltage reference to the linear regulator, wherein the first voltage reference generator is a VDD powered voltage reference generator 610. In some embodiments, as illustrated in FIG. 3, initially the VDD powered voltage reference generator 310 provides the bias current Ib101, which causes M101, M102, R101, R102, and M103 to operate, and generates a first voltage reference Vref1 to be provided to the linear regulator (where Vref1 equals Ib101*R101+Vgsm101−Vgsm102, where Vgsm101 is the voltage from gate to source of M101 and Vgsm102 is the voltage from gate to source of M102).

In some embodiments, the linear regulator commences operation 615 and produces a Vreg regulated power supply output 620. In some embodiments, the regulated power supply output from the linear regulator is provided to a second voltage reference generator, the second voltage reference generator being a Vreg powered voltage reference generator 625.

In some embodiments, a second voltage reference is generated by the Vreg voltage reference generator 630. As shown in FIG. 3, upon the Vreg powered voltage reference generator 330 being enabled, such circuit provides the bias current Ib102, which causes M104, M105, R103, and M106 to operate, and generates the second voltage reference Vref2.

In some embodiments, the voltage reference and power supply for the linear regulator are switched. In some embodiments, the first voltage reference Vref1 is replaced by the second voltage reference Vref2 as the reference for the linear regulator 640. (where Vref2 equals Ib102*R103+Vgsm105−Vgsm106, where Vgsm105 is the voltage from gate to source of M105 and Vgsm106 is the voltage from gate to source of M106) 635. Simultaneously, a part of the power supply for the linear regulator is switched from the original system power supply (VDD) to the regulator generated power supply (Vreg) 645. In some embodiments, the part of the power supply for the linear regulator is a portion of the power supply for an error amplifier of the linear regulator. In some embodiments, the linear regulator circuit ensures that the linear regulator itself and its voltage reference continue operating when switching the reference and the power supply.

Figure 7:
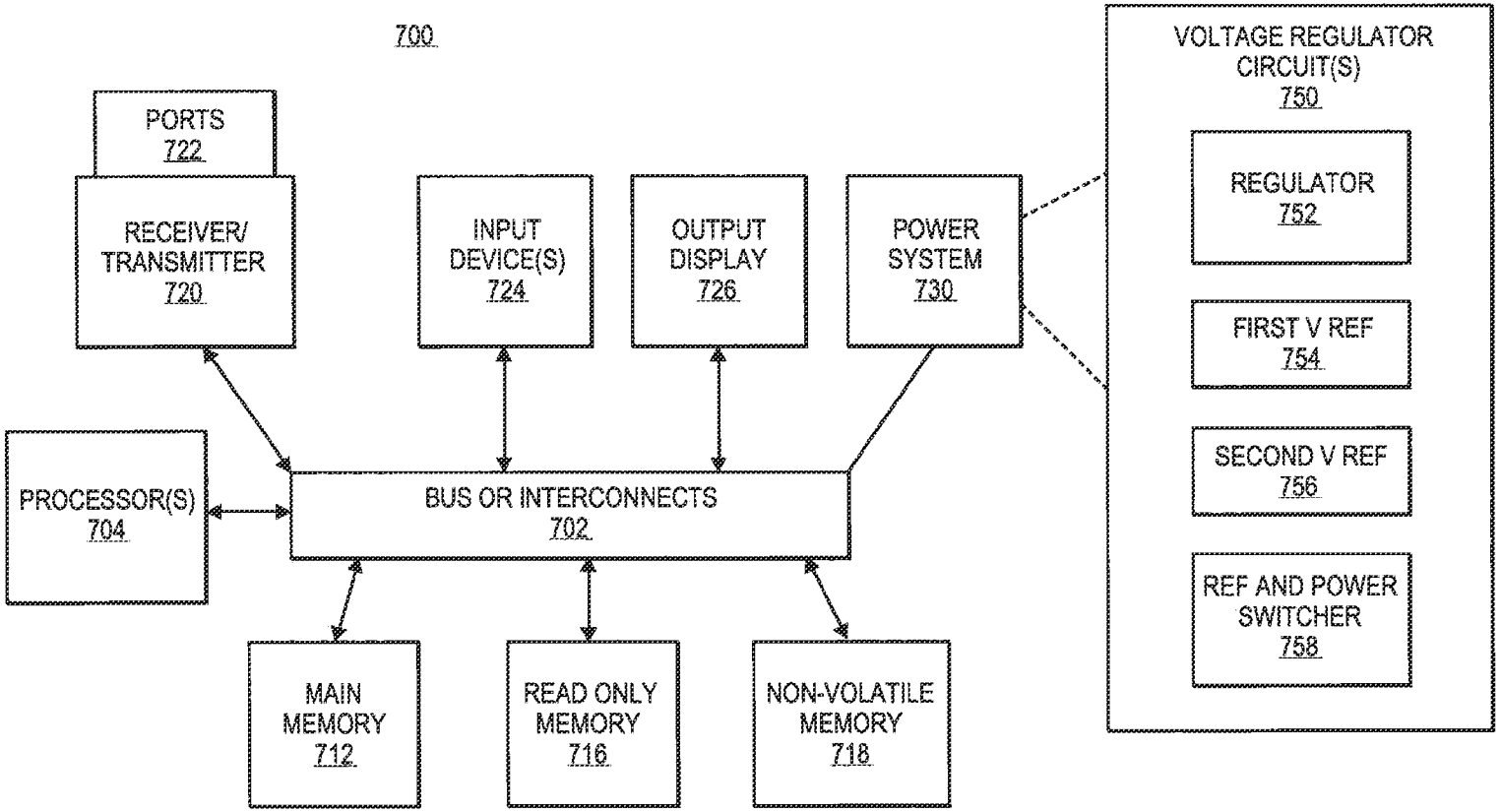
FIG. 7 is an illustration of an apparatus or system including a linear regulator in a power system.

FIG. 7 is an illustration of an apparatus or system including a linear regulator in a power system.

In some embodiments, an apparatus or system 700 (generally referred to herein as an apparatus) includes a power system 730, which may include a power supply, a battery, a solar cell, a fuel cell, or other system or device for providing or generating power. The power provided by the power device or system 730 may be distributed as required to elements of the apparatus 700.

In some embodiments, the power system 730 includes a voltage regulator circuit 750, the voltage regulator circuit including a linear regulator 752, such as linear regulator 220 illustrated in FIG. 2. In some embodiments, the voltage regulator circuit 750 includes a first reference regenerator 754, wherein the first reference generator may be a VI) powered reference generator, such as VI) powered reference generator 205 illustrated in FIG. 2, that initially provides a first voltage reference to the linear regulator 752. In some embodiments, the voltage regulator circuit 750 includes a second voltage reference generator 756, wherein the second voltage reference generator may be a Vreg powered voltage reference generator, such as Vreg powered voltage reference generator 230 illustrated in FIG. 2, that provides a second voltage reference to the linear regulator 752 after a switching operation. In some embodiments, the voltage regulator circuit 750 includes a reference and power switcher 758, such as reference and power switcher 210 illustrated in FIG. 2, to switch the voltage reference from the first voltage reference to the second voltage reference and at least a portion of power delivery from an initial power source to a power source generated by the linear regulator 752.

The apparatus 700 may further include a processing means such as one or more processors 704 coupled with the interconnect 702 for processing information. The processors 704 may comprise one or more physical processors and one or more logical processors. The interconnect 702 is illustrated as a single interconnect for simplicity, but may represent multiple different interconnects or buses and the component connections to such interconnects may vary. The interconnect 702 shown in FIG. 7 is an abstraction that represents any one or more separate physical buses, point-to-point connections, or both connected by appropriate bridges, adapters, or controllers.

In some embodiments, the apparatus 700 further comprises a random access memory (RAM) or other dynamic storage device or element as a main memory 712 for storing information and instructions to be executed by the processors 704. In some embodiments, main memory may include active storage of applications including a browser application for using in network browsing activities by a user of the apparatus 700. In some embodiments, memory of the apparatus may include certain registers or other special purpose memory.

The apparatus 700 also may comprise a read only memory (ROM) 716 or other static storage device for storing static information and instructions for the processors 704. The apparatus 700 may include one or more non-volatile memory elements 718 for the storage of certain elements, including, for example, flash memory and a hard disk or solid-state drive.

One or more transmitters or receivers 720 may also be coupled to the interconnect 702. In some embodiments, the receivers or transmitters 720 may include one or more ports 722 for the connection of other apparatuses.

The apparatus 700 may also be coupled via the interconnect 702 to an output display 726. In some embodiments, the display 726 may include a liquid crystal display (LCD) or any other display technology, for displaying information or content to a user, including three-dimensional (3D) displays. In some environments, the display 726 may include a touch-screen that is also utilized as at least a part of an input device. In some environments, the display 726 may be or may include an audio device, such as a speaker for providing audio information.

In the description above, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form. There may be intermediate structure between illustrated components. The components described or illustrated herein may have additional inputs or outputs that are not illustrated or described. The illustrated elements or components may also be arranged in different arrangements or orders, including the reordering of any fields or the modification of field sizes.

The present invention may include various processes. The processes of the present invention may be performed by hardware components or may be embodied in computer-readable instructions, which may be used to cause a general purpose or special purpose processor or logic circuits programmed with the instructions to perform the processes. Alternatively, the processes may be performed by a combination of hardware and software.

Portions of the present invention may be provided as a computer program product, which may include a computer-readable non-transitory storage medium having stored thereon computer program instructions, which may be used to program a computer (or other electronic devices) to perform a process according to the present invention. The computer-readable storage medium may include, but is not limited to, floppy diskettes, optical disks, CD-ROMs (compact disk read-only memory), and magneto-optical disks, ROMs (read-only memory), RAMs (random access memory), EPROMs (erasable programmable read-only memory), EEPROMs (electrically-erasable programmable read-only memory), magnet or optical cards, flash memory, or other type of media/computer-readable medium suitable for storing electronic instructions. Moreover, the present invention may also be downloaded as a computer program product, wherein the program may be transferred from a remote computer to a requesting computer.

Many of the methods are described in their most basic form, but processes may be added to or deleted from any of the methods and information may be added or subtracted from any of the described messages without departing from the basic scope of the present invention. It will be apparent to those skilled in the art that many further modifications and adaptations may be made. The particular embodiments are not provided to limit the invention but to illustrate it.

If it is said that an element "A" is coupled to or with element "B," element A may be directly coupled to element B or be indirectly coupled through, for example, element C. When the specification states that a component, feature, structure, process, or characteristic A "causes" a component, feature, structure, process, or characteristic B, it means that "A" is at least a partial cause of "B" but that there may also be at least one other component, feature, structure, process, or characteristic that assists in causing "B." If the specification indicates that a component, feature, structure, process, or characteristic "may", "might", or "could" be included, that particular component, feature, structure, process, or characteristic is not required to be included. If the specification refers to "a" or "an" element, this does not mean there is only one of the described elements.

An embodiment is an implementation or example of the invention. Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. It should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects.

In some embodiments, an apparatus includes an linear regulator to receive a system power supply and to generate a regulated power supply; a first voltage reference generator to generate a first voltage reference for the linear regulator; a second voltage reference generator to generate a second voltage reference for the linear regulator; and a voltage reference and power switcher. In some embodiments, the voltage reference and power switcher is to switch a voltage reference for the linear regulator from the first voltage reference to the second voltage reference and is to switch a part of a power supply for the linear regulator from the system power supply to the regulated power supply.

In some embodiments, the voltage reference and power switcher is to switch the voltage reference and the power supply at a same time.

In some embodiments, the voltage reference and power switcher are to disable the first voltage reference upon switching to the second voltage reference.

In some embodiments, the first voltage reference generator is powered by the system power supply. In some embodiments, the second voltage reference generator is powered by the regulated power supply.

In some embodiments, the voltage reference and power switcher includes a differential pair of transistors, wherein a first transistor of the differential pair of transistors receives a first bias voltage generated by the first voltage reference generator and a second transistor of the differential pair of transistors receivers a second bias voltage generated by the second voltage reference generator. In some embodiments, the switching of the voltage reference and power switcher includes switching being caused when the second bias voltage is greater than the first bias voltage.

In some embodiments, the first voltage reference generator includes a first current source and the second voltage reference generator includes a second current source, the first current source being enabled prior to the second current source when the apparatus is enabled. In some embodiments, the first current source is enabled when the first voltage reference generator receives the system power supply and the second current source is enabled when the second reference generator receives the regulated power supply.

In some embodiments, the linear regulator includes an error amplifier, wherein the part of the power supply for the linear regulator switched from the system power supply to the regulated power supply is a portion of a power supply for the error amplifier.

In some embodiments, a method includes initializing a voltage regulator circuit; generating a first voltage reference by a first voltage reference generator; providing the first voltage reference to a linear regulator, the linear regulator receiving a system power supply voltage; generating a regulated power supply voltage by the linear regulator, providing the regulated power supply voltage to the second voltage reference generator; generating a second voltage reference by the second voltage reference generator; and switching a voltage reference for the linear regulator from the first voltage reference to the second voltage reference and switching a part of a power supply for the linear regulator from the system power supply to the regulated power supply.

In some embodiments, the switching of the voltage reference for the linear regulator and switching of the part of the power supply for the linear regulator are performed simultaneously.

In some embodiments, switching a voltage reference for the linear regulator from the first voltage reference to the second voltage reference further includes disabling the first voltage reference.

In some embodiments, the method further includes generating a first bias voltage by the first voltage reference generator and generating a second bias voltage by the second voltage reference generator. In some embodiments, the switching of the voltage reference for the linear regulator and the switching of the part of the power supply for the linear regulator occurs upon the second bias voltage being greater than the first bias voltage. In some embodiments, the method further includes generating a first current by a first current source of the first voltage reference generator and generating a second current by a second current source of the second voltage reference generator, the generation of the first current occurring prior to the generation of the second current.

In some embodiments, a non-transitory computer-readable storage medium having stored thereon data representing sequences of instructions that, when executed by a processor, cause the processor to perform operations comprising one or more of the processes of the method.

In some embodiments, the switching of the part of the power supply for the linear regulator includes switching a portion of a power supply for an error amplifier of the linear regulator.

In some embodiments, a circuit to provide a voltage reference includes a first circuit portion to provide a first reference for a linear regulator, the linear regulator to receive a system power supply voltage and to generate a regulated power supply voltage, the first circuit including a connection to the system power supply voltage; a second circuit portion to provide a second reference for the linear regulator, the second circuit portion including a connection to the regulated power supply voltage; and a third circuit portion to provide switching between the first reference produced by the first circuit portion and the second reference produced by the second circuit portion.

In some embodiments, the third circuit portion includes: a differential pair of transistors including a first differential transistor and a second differential transistor; and a resistor coupled to the differential pair of transistors.

In some embodiments, the first differential transistor receives a first bias voltage generated by the first circuit portion and the second differential transistor receives a second bias voltage generated by the second circuit portion. In some embodiments, the differential pair of transistors switches from the first reference voltage to the second reference voltage when the second bias voltage is greater than the first bias voltage.

In some embodiments, the first circuit portion includes a first current source and the second circuit portion includes a second current source, the first current source being enabled prior to the second current source being enabled when the circuit is enabled.

In some embodiments, the first current source is enabled when the first circuit portion receives the system power supply voltage and the second current source is enabled when the second circuit portion receives the regulated power supply voltage.

In some embodiments, switching between the first reference produced by the first circuit portion and the second reference produced by the second circuit portion further includes disabling the first reference.

In some embodiments, an apparatus includes means for initializing a voltage regulator circuit; means for generating a first voltage reference by a first voltage reference generator; means for providing the first voltage reference to a linear regulator, the linear regulator receiving a system power supply voltage; means for generating a regulated power supply voltage by the linear regulator, means for providing the regulated power supply voltage to the second voltage reference generator; means for generating a second voltage reference by the second voltage reference generator; and means for switching a voltage reference for the linear regulator from the first voltage reference to the second voltage reference and switching a part of a power supply for the linear regulator from the system power supply to the regulated power supply.

What is claimed is:

1. An apparatus comprising:

a linear regulator to receive a system power supply and to generate a regulated power supply, the linear regulator comprising an error amplifier;

a first voltage reference generator to generate a first voltage reference for the linear regulator;

a second voltage reference generator to generate a second voltage reference for the linear regulator; and a voltage reference and power switcher;

wherein the voltage reference and power switcher is to switch a voltage reference for the linear regulator from the first voltage reference to the second voltage reference and is to switch a power supply for the error amplifier of the linear regulator from the system power supply to the regulated power supply.

2. The apparatus of claim 1, wherein the voltage reference and power switcher is to switch the voltage reference and the power supply at a same time.

3. The apparatus of claim 1, wherein the voltage reference and power switcher are to disable the first voltage reference upon switching to the second voltage reference.

4. The apparatus of claim 1, wherein the first voltage reference generator is powered by the system power supply.

5. The apparatus of claim 1, wherein the second voltage reference generator is powered by the regulated power supply.

6. The apparatus of claim 1, wherein the voltage reference and power switcher includes a differential pair of transistors, wherein a first transistor of the differential pair of transistors receives a first bias voltage generated by the first voltage reference generator and a second transistor of the differential pair of transistors receivers a second bias voltage generated by the second voltage reference generator.

7. The apparatus of claim 6, wherein the switching of the voltage reference and power switcher includes switching being caused when the second bias voltage is greater than the first bias voltage.

8. The apparatus of claim 1, wherein the first voltage reference generator includes a first current source and the second voltage reference generator includes a second current source, the first current source being enabled prior to the second current source when the apparatus is enabled.

9. The apparatus of claim 8, wherein the first current source is enabled when the first voltage reference generator receives the system power supply and the second current source is enabled when the second reference generator receives the regulated power supply.

10. A method comprising:

initializing a voltage regulator circuit;

generating a first voltage reference by a first voltage reference generator;

providing the first voltage reference to a linear regulator, the linear regulator comprising an error amplifier and receiving a system power supply voltage;

generating a regulated power supply voltage by the linear regulator;

providing the regulated power supply voltage to the second voltage reference generator;

generating a second voltage reference by the second voltage reference generator; and switching a voltage reference for the linear regulator from the first voltage reference to the second voltage reference and switching a power supply for the error amplifier of the linear regulator from the system power supply to the regulated power supply.

11. The method of claim 10, wherein the switching of the voltage reference for the linear regulator and the switching of the power supply for the error amplifier of the linear regulator are performed simultaneously.

12. The method of claim 10, wherein switching a voltage reference for the linear regulator from the first voltage reference to the second voltage reference further includes disabling the first voltage reference.

13. The method of claim 10, further comprising generating a first bias voltage by the first voltage reference generator and generating a second bias voltage by the second voltage reference generator.

14. The method of claim 12, wherein the switching of the voltage reference for the linear regulator and the switching of the power supply for the error amplifier of the linear regulator occurs upon the second bias voltage being greater than the first bias voltage.

15. The method of claim 14, further comprising generating a first current by a first current source of the first voltage reference generator and generating a second current by a second current source of the second voltage reference generator, the generation of the first current occurring prior to the generation of the second current.

16. A circuit to provide a voltage reference comprising:

a first circuit portion to provide a first reference for a linear regulator, the linear regulator to receive a system power supply voltage and to generate a regulated power supply voltage, the first circuit portion including a connection to the system power supply voltage;

a second circuit portion to provide a second reference for the linear regulator, the second circuit portion including a connection to the regulated power supply voltage; and a third circuit portion to provide switching between the first reference produced by the first circuit portion and the second reference produced by the second circuit portion for a linear regulator and to provide switching of a power supply to an error amplifier of the linear regulator between the system power supply voltage and the regulated power supply voltage.

17. The circuit of claim 16, wherein the third circuit portion includes:

a differential pair of transistors including a first differential transistor and a second differential transistor; and a resistor coupled to the differential pair of transistors.

18. The circuit of claim 17, wherein the first differential transistor receives a first bias voltage generated by the first circuit portion and the second differential transistor receives a second bias voltage generated by the second circuit portion.

19. The circuit of claim 18, wherein the differential pair of transistors switches from the first reference voltage to the second reference voltage when the second bias voltage is greater than the first bias voltage.

20. The circuit of claim 16, wherein the first circuit portion includes a first current source and the second circuit portion includes a second current source, the first current source being enabled prior to the second current source being enabled when the circuit is enabled.

21. The circuit of claim 20, wherein the first current source is enabled when the first circuit portion receives the system power supply voltage and the second current source is enabled when the second circuit portion receives the regulated power supply voltage.

22. The circuit of claim 16, wherein switching between the first reference produced by the first circuit portion and the second reference produced by the second circuit portion further includes disabling the first reference.

* * * * *